United States Patent [19]

Hallström

[11] Patent Number: 4,479,282

[45] Date of Patent: Oct. 30, 1984

[54] CLEANING TROLLEY

[76] Inventor: Bengt O. Hallström, Bränninge Gård, S-151 39 Södertälje, Sweden

[21] Appl. No.: 447,756

[22] Filed: Dec. 8, 1982

[30] Foreign Application Priority Data

Apr. 23, 1982 [SE] Sweden ..... 8202557

[51] Int. Cl.[3] ..... A47L 5/38

[52] U.S. Cl. ..... 15/311; 15/307; 15/331

[58] Field of Search ..... 15/303, 307, 331, 334, 15/310, 311, 328

[56] References Cited

U.S. PATENT DOCUMENTS 2,625,703 1/1953 Devau ..... 15/331 X

FOREIGN PATENT DOCUMENTS 511492 4/1955 Canada ..... 15/307
1198210 6/1959 France ..... 15/311
730768 5/1955 United Kingdom ..... 15/307

*Primary Examiner*—Chris K. Moore

[57] ABSTRACT

A cleaning trolley comprising a stand movable on wheels, provided with a table and a vibrating suction box arranged therein, said suction box having a regulating block for regulating the operating length of the suction box, and said stand also carrying a vacuum cleaning unit with a lid-closed container for collecting dust and scrap particles and a suction assembly. According to the invention the lid is provided with a disc-shaped switching means for the suction path, which is pivotably journalled about a vertical axis and which has two openings spaced at a predetermined distance from each other and equidistant from the axis, for alignment with the inlet of the lid, one of the openings being connected to the suction box via a suction tube and the other opening being connected to a freely movable suction tube, the openings and suction tubes forming two section paths for arbitrary connection by turning the suction-path disc-switch to a position aligning one of the openings with the inlet of the lid. Further, said regulating block has a flexible tongue formed by a vertical recess, the hole-part of the through-hole in the tongue having its central axis located at an angle to the central axis of the rest of the hole-part and the hole-part of the tongue being arranged to be aligned axially with the rest of the hole to enable displacement of the regulating block along the guide member, the tongue being locked to the guide member by means of its inherent spring force. A means is arranged on the vacuum cleaning unit opposite the outlet, to further clean the air flowing out and to distribute the air flow to the sides and obliquely forwards in that the means includes a holder open on all sides, and a porous body exchangably arranged therein to clean and distribute the air.

3 Claims, 7 Drawing Figures

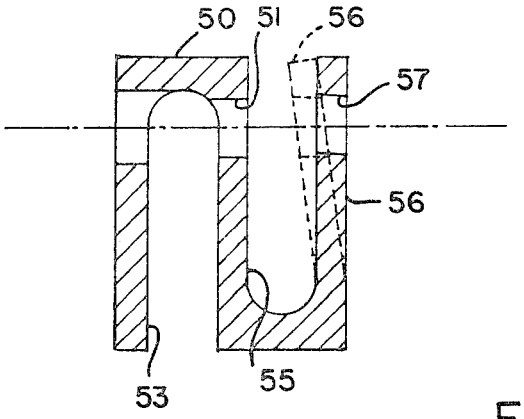
FIG. 6
FIG. 5
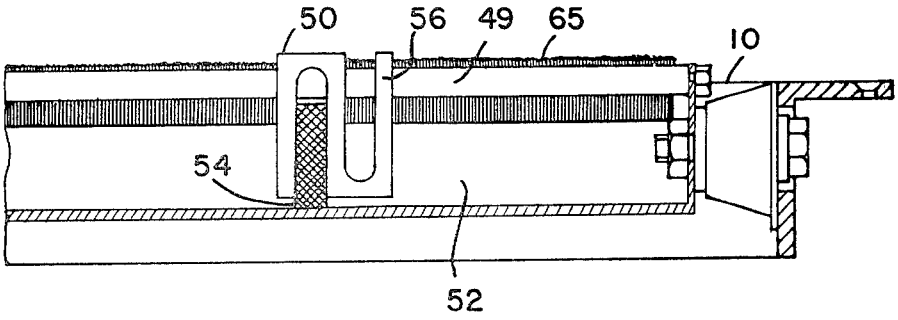
FIG. 4
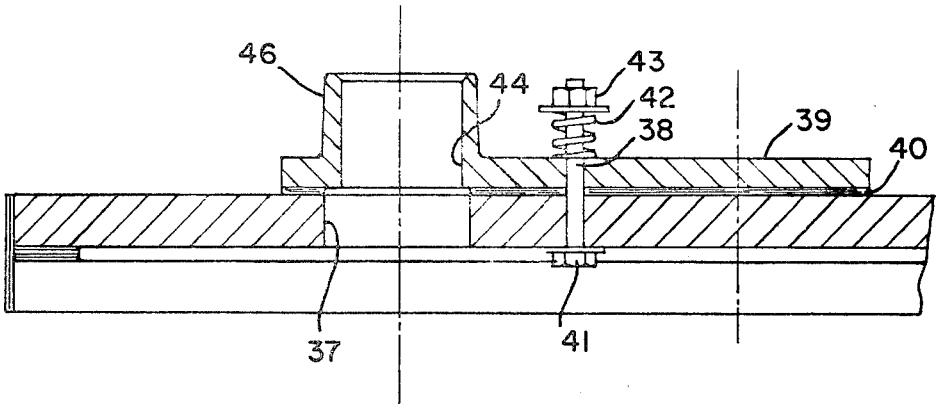

CLEANING TROLLEY

The present invention relates to a cleaning trolley comprising a stand movable on wheels, provided with a table in which is arranged a vibrating suction box, and two extension leaves hingedly arranged opposite each other on the stand and cooperating with said table, the suction box being provided with a regulating block movable along a guide member and provided with a through-hole for the guide member, in order to regulate the operating length of the suction box. The stand also carries a vacuum cleaning unit located under the table and comprising a container for collecting dust and scrap particles from a flow of suction air being drawn in and a suction assembly located below the container and connected thereto, the container being closed by a lid with an inlet for said flow of suction air, while the suction assembly is provided with an outlet to blow out the flow of suction air.

The object of the present invention is to provide for a functional cleaning trolley, improved in many respects, which can easily be moved between different cleaning places and which can be locked when necessary, so that it stands firmly on the floor. The cleaning trolley eliminates troublesome carpet-beating racks and heavy, bulky and unhygienic transports of pillows, quilts, blankets, mattresses, rugs and clothing. It is also an object of the invention to provide for an improved cleaning trolley of the type having a suction box whose operating length can quickly and easily be adapted to the object to be suction-cleaned, and to enable the desired suction tool to be quickly and easily connected.

The novelty of the invention lies in that the lid is provided with a disc-shaped switching means for the suction path, which is pivotably journalled about a vertical axis and which has two openings spaced at a predetermined distance from each other and equidistant from the axis, for alignment with the inlet of the lid, one of the openings being connected to the suction box via a suction tube and the other opening being connected to a freely movable suction tube, the openings and suction tubes forming two suction paths for arbitrary connection by turning the suction-path disc-switch to a position aligning one of the openings with the inlet of the lid; that the regulating block has a flexible tongue formed by a vertical recess, the hole-part of the through-hole in the tongue having its central axis located at an angle to the central axis of the rest of the hole-part and the hole-part of the tongue being arranged to be aligned axially with the rest of the hole to enable displacement of the regulating block along the guide member, the tongue being locked to the guide member by means of its inherent spring force; and that a special means is located on the vacuum cleaning unit opposite the outlet, to further clean the air flowing out and to also distribute the air flow to the sides and obliquely forwards in that the means includes a holder open on all sides, and a porous body exchangably arranged therein to clean and distribute the air.

Since the cleaning trolley is easily movable it is extremely versatile for use everywhere where several areas are usually cleaned one after the other, such as in hospitals, hotels, offices, etc.

The invention will be described in more detail in the following, with reference to the drawings, in which FIG. 1 shows a cleaning trolley from one of the short sides in accordance with a preferred embodiment of the invention, FIG. 2 shows a vacuum cleaning unit, partially in cross-section, which is included in the cleaning trolley according to FIG. 1.

FIG. 4 is a cross-section of a part of the lid and its suction-path switching means in the vacuum cleaning unit according to FIG. 2.

FIG. 5 is a longitudinal cross-section of a part of a suction box included in the cleaning trolley according to FIG. 1.

FIG. 6 shows a regulating block included in the suction box according to FIG. 5.

Figure 1:
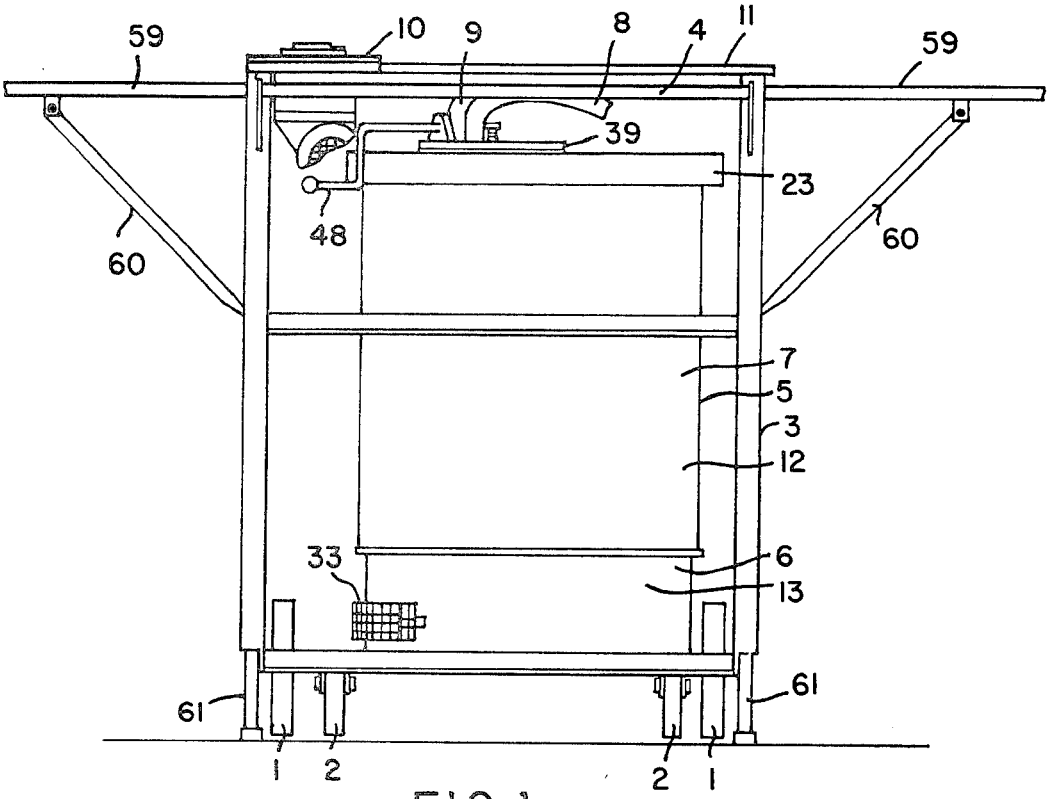
Figure 7:
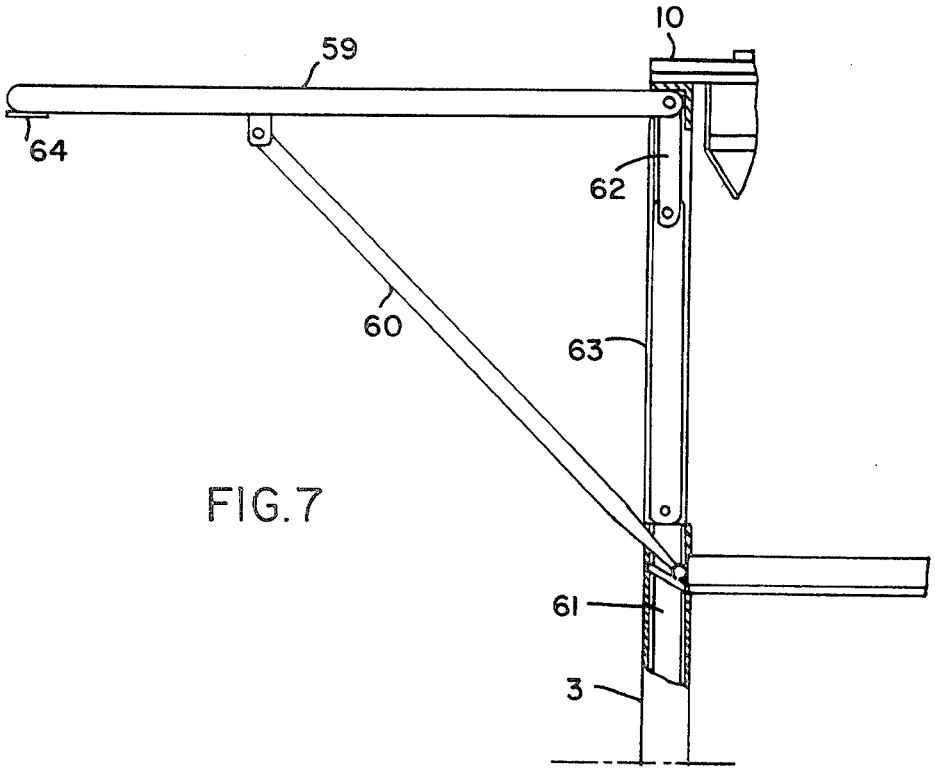
FIG. 7 shows a part of the cleaning trolley according to FIG. 1.
Figure 2:
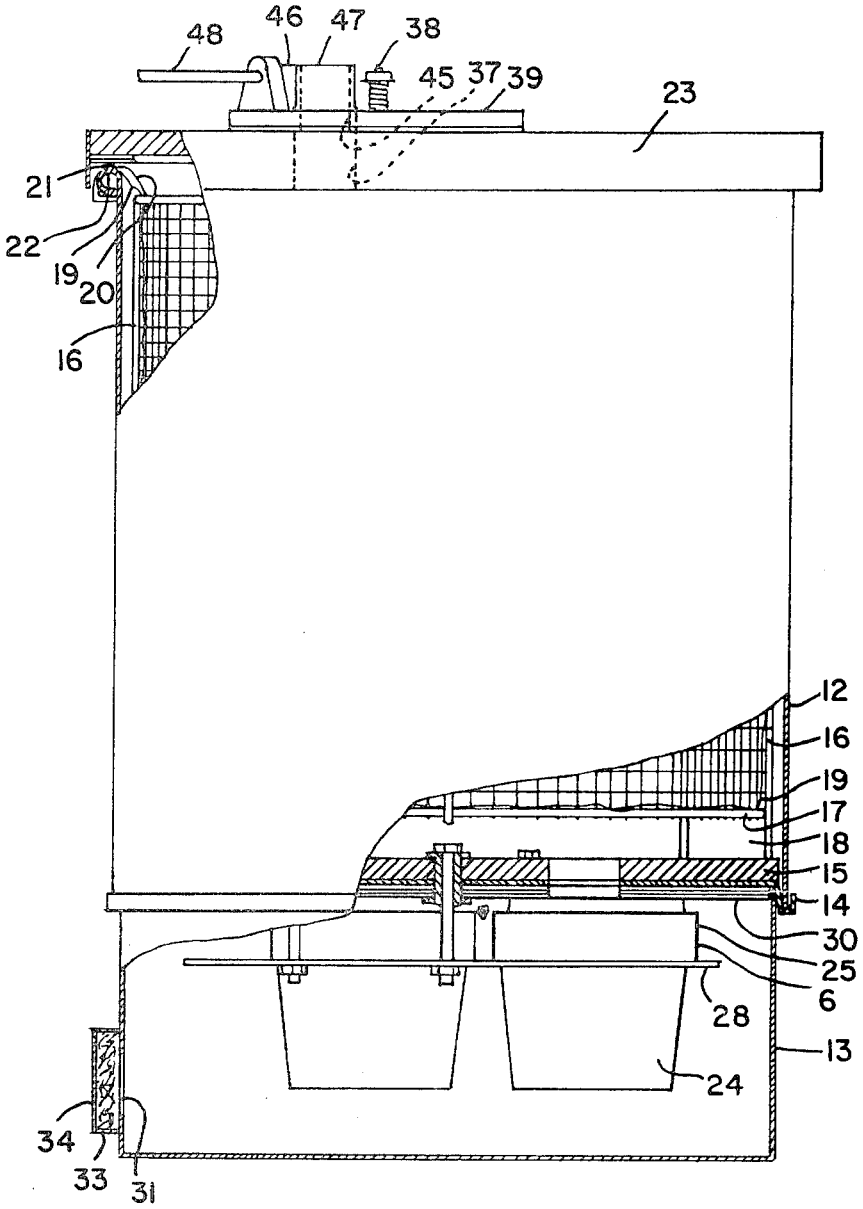
Figure 3:
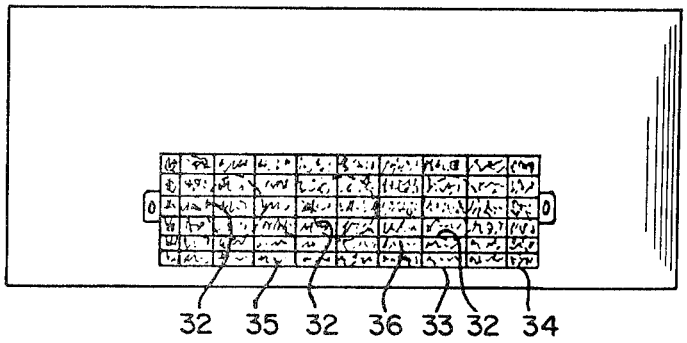
FIG. 3 shows a means for distributing and cleaning air, in the vacuum cleaning unit according to FIG. 2.

FIG. 1 shows schematically a cleaning trolley comprising a stand 3 supported by two pairs of wheels 1, 2, the wheels 2 in one of the pairs being pivotable about a vertical axis to enable the trolley to be steered during transport, this being performed with the help of a handle 4 on one of the short sides. The cleaning trolley also includes a vacuum cleaning unit 5 with a suction assembly 6 and a dust and waste separator 7. A first suction tube or hose 8 which is freely movable and which can be extended if necessary, is connected to the vacuum cleaning unit for vacuum-cleaning floors, walls and ceilings, and a second suction tube or hose 9 connecting the vacuum cleaning unit 5 to a vibrating, elongate suction box 10 which is journalled and embedded in a table 11 uppermost on the stand.

The dust and waste separator 7 of the vacuum cleaning unit is provided with a container 12 and, below that, a motor-box 13. The container has a bottom wall 14 and a thick inner sheet 15 of wood or the like. In the container is a mesh or wire basket 16, the bottom 17 of which is spaced from the sheet 15 to provide a space 18 for the air-flow from inside the container. Inside the mesh basket 16 is an outer bag 19 and an easily exchangeable inner bag 20 of suitable material, such as cotton, the outer bag having the ability to filter off even extremely fine dust and particles from the air drawn in, while the inner bag, with slightly poorer filtering properties, is able to filter off and collect coarser particles and the majority of fine dust from the airflow drawn in. The outer bag has a metal ring 21 arranged to rest against the upper edge 22 of the container, thus positioning the bags by clamping their edges between the upper edge of the container and a lid 23 closing the container.

The lower motor-box 13 contains said suction assembly 6, consisting of three suction fans 25, each driven by an electric motor 24 and communicating with the inner space 18 of the container 12 via individual openings 26 in the bottom wall 14 and thick sheet 15 of the container, and secured to the thick sheet by means of a number of bolts 27 passing through a horizontal motor support 28 carrying the suction fans 25 and their motors 24. Within the area of the bottom wall 14 and the thick sheet 15 is an insulating sleeve 29 for each bolt 27. The insulating sleeves surrounding the bolts thus insulate the container 12 from the suction assembly 6 so that the transfer of vibration from the motors and fan is reduced. The motor box also includes a rubber sheet 30 covering and in contact with the underside of the container bottom wall 14. This rubber sheet is provided to prevent the transfer of creeping currents from the suction assembly 6 to the container 12.

The motor box 13 is provided with a side outlet 31 for the air-flow drawn into the container. In the embodiment shown, this side outlet has three openings 32 arranged peripherally one after the other and spaced from each other. A finger protection (not shown) is preferably arranged on one or more spacers inside the openings 32. On the outside of the motor box is a special multi-function means 33 for additional filtering of the outflowing air and to distribute the air-flow to the surroundings outside to prevent a concentrated air-flow from the vacuum cleaning unit which might disturb the operator. The multi-functional means comprises an elongate holder 34, substantially rectangular in cross-section, which may be arched (at least on the inside) corresponding to the curved shape of the cylindrical motor box, and which is open on all sides, said holder having walls made of wire-mesh or the like, with large mesh width, or in some other suitable manner so that there will be a large number of holes 35 for the air-flow. The holder is fixed to the motor box 13. The means 33 also includes a porous, permeable, sheet-shaped body 36 of suitable material with filtering properties, such as a Viledon sheet. Said body is designed for insertion into the holder, this being completely open at the top, filling the inner space of the holder and abutting the three openings 32 in the motor box. The special filter sheet can catch extremely small particles and fibres (of micro-size) accompanying the air-flow through the filter. The combination of a filter sheet and the maximally open holder, results in the air-flow being distributed to the sides and obliquely forward so that the air will not flow out immediately in front of the openings 32.

Instead of the three smaller openings, the motor box may be provided with a single large opening, in order to obtain as large an area as possible where the air-flow comes into contact with the filter sheet. The filter sheet is preferably replaceable, the old one either being discarded or cleaned for re-use.

The lid 23 to close the container has an opening 37 of predetermined size for the air flowing in and a suction-path switcher 39 pivotable about a vertical axis 38 on the lid and being in the form of a circular turning disc covering the opening 37 of the lid and being provided on its lower side with a layer 40 of sealing material so that air is prevented from flowing into the opening between disc and lid. The contact pressure of the disc against the lid is preferably adjusted by an adjustment means, the pivoting axis, for instance, comprising a bolt 41 passing through the lid and provided with a spring 42 and nut 43 to compress the spring to the desired extent to achieve the necessary seal and so that the disc can still easily be turned. The disc 39 has two openings 44, 45 spaced from each other, equidistant with the opening 37 from the axis 38 and arranged by turning of the disc, to be optionally aligned fully with the lid opening 37 to obtain full suction effect, or partially therewith if reduced suction effect is desired. The openings in the pivotable disc are surrounded by pipe shafts 46, 47 for the suction-tube connection 9 to the suction box 1O or for the freely movable suction tube 8 to which can be fitted various vacuum cleaning tools, besides it acting as such a tool for certain purposes. The disc 39 has an easily accessible pivot arm 48, extending outside the lid 23 and cooperating with two stops (not shown) fixed to the lid, providing the end positions to which the disc 39 can be turned. In one end position the opening 44 in the disc is fully over the lid opening 37 in order to provide full suction effect at the suction box 1O, and in the other end position, the other opening 45 of the disc is fully over the lid opening 37 to achieve full suction effect at the orifice of the freely movable suction tube. The turning disc thus enables quick and simple switching of the suction paths from one suction place to another to give full suction effect, as well as quick and simple switching within each end position to regulate the suction effect for each place. The opening 44, pipe shaft 46 and suction tube connection 9 to the suction box 1O are preferably dimensioned slightly larger than the corresponding parts for the freely movable suction tube.

Said suction box 1O is designed to vibrate or oscillate with the help of a vibrating means (not shown) driven by an electric motor. This produces extremely rapid, short movements in the suction box journalled at its ends so that a carpet, mattress or other object passed over the suction gap and its brush-strip 65 is subjected to a favourable beating effect. A guide tube 49 is arranged in the suction box, between its ends, carrying a gap-regulating means 50 movable along the guide member, in the form of a block of a suitable plastic material, such as nylon, which eliminates all unpleasant friction noise. The block 50 is provided with a through-hole 51, through which the guide member extends, and has a cross-section (seen at right-angles to said hole) which is adjusted to the inner space 58 of the suction box, with a small clearance to the side walls and bottom of the suction box. The block is provided with a first, downwardly open recess 53, in which a seal 54 of suitable material is arranged projecting out towards the side walls and bottom of the suction box, to provide sliding and sealing abutment against these surfaces. The block is also provided with a second, upwardly-directed recess 55 to form a flexible locking tongue 56. The hole-part 57 of the through-hole in the block, which is located in the locking tongue 56 is not coaxial with the rest of the hole-part 58. Instead, its axis forms a slight angle with the axis of the rest of the hole-part 58, so that these axes are only aligned with each other after the locking tongue 56 has been bent in towards said second recess 55 from its normal position of rest, as illustrated in FIG. 6. It will be understood that this inward bending of the locking tongue, performed manually, enables the block 50 to be moved easily to and fro along the guide member in the suction box to the desired working position to give the suction box the desired suction length, and that the block can be effectively locked in the desired working position when the locking tongue is permitted to return in the direction of its original position, since it presses against the guide tube 49 at the inner walls of the hole-part 57.

The cleaning trolley is also equipped with two extension leaves 59 on opposite longitudinal sides of the table, each of which is held in raised position by a pivotable support arm 60 on the lower side of the leaf. Each extension leaf is pivotably journalled at the stand 3 and, in the vicinity of each short end of the cleaning trolley the leaf is connected to a vertical support leg 61, the two support legs are guided and are movable up and down in the stand 3 to assume a raised position when the extension leaf is lowered, whereupon the cleaning trolley can be moved along on its wheels. When the extension leaves 59 are raised, this movement forces the support legs down to press on the floor, lifting the cleaning trolley from the floor so that it is supported in a stationary position by the four support legs 61 as shown in FIG. 1. This is enabled by said connection between the extension leaf and the support leg 61 at each short end of the cleaning trolley consisting of a torque arm 62 which is permanently fixed to the extension leaf, and a link arm 63, which is pivotably joined to both the torque arm 62 and the support leg 61. When the support arm 60 has been lifted slightly from its support point on the stand, the torque arm and link arm can swing inwards when the extension leaf is flapped down towards the longitudinal side of the cleaning trolley, simultaneously raising the support leg 61. The leaf is then retained by magnetic strips 64.

The cleaning trolley shown is also provided with shelves for various cleaning accessories and for buckets and rubbish sacks, a special holder for a rubbish sack, holders for suction tubes and pipes with nozzles, as well as switches for turning on the vibrator and suction assembly. These components are not shown in the drawings.

What I claim is:

1. A cleaning trolley comprising a stand movable on wheels, provided with a table in which is arranged a vibrating suction box, and two extension leaves hingedly arranged opposite each other on the stand and cooperating with said table, the suction box being provided with a regulating block movable along a guide member and provided with a throughhole for the guide member, in order to regulate the operating length of the suction box, said stand carrying a vacuum cleaning unit located under the table and comprising a container for collecting dust and scrap particles from a flow of suction air being drawn in and a suction assembly located below the container and connected thereto, the container being closed by a lid with an inlet for said flow of suction air, while the suction assembly is provided with an outlet to blow out the flow of suction air; said lid being provided with a disc-shaped switching means for the suction path, which is pivotably journalled about a vertical axis and which has two openings spaced at a predetermined distance from each other and equidistant from the axis, for alignment with the inlet of the lid, one of the openings being connected to the suction box via a suction tube and the other opening being connected to a freely movable suction tube, the openings and suction tubes forming two suction paths for arbitrary connection by turning the suction-path disc-switch to a position aligning one of the openings with the inlet of the lid; said regulating block having a flexible tongue formed by a vertical recess, the hole-part of the through-hole in the tongue having its central axis located at an angle to the central axis of the rest of the hole-part and the hole-part of the tongue being arranged to be aligned axially with the rest of the hole to enable displacement of the regulating block along the guide member, the tongue being locked to the guide member by means of its inherent spring force; and a combined air cleaning and distributing means being arranged on the vacuum cleaning unit opposite the outlet, to further clean the air flowing out and to distribute the air flow to the sides and obliquely forwards, said means including a holder open on all sides, and a porous body exchangably arranged therein to clean and distribute the air.

2. A cleaning trolley according to claim 1 wherein each of said extension leaves is pivotably journalled in the stand and joined to two vertical support legs via link arms and torque arms permanently fixed to the extension leaf, said support legs being arranged to be pressed down towards the floor when the extension leaf is lifted, thus causing the cleaning trolley to remain stationary in the desired place.

3. A cleaning trolley according to claim 1 wherein said container and suction assembly are separated by a rubber disc arranged to prevent transfer of creep currents from the suction assembly to the container.

* * * * *